US005844458A

United States Patent [19]

Bartholomew et al.

[11] Patent Number: 5,844,458

[45] Date of Patent: Dec. 1, 1998

[54] RESILIENT AND COMPRESSIBLE MAGNET MODULE FOR DOOR CHANNEL INSTALLATION

[75] Inventors: Victor L. Bartholomew, Tigard; Mark S. Taft, West Linn, both of Oreg.

[73] Assignee: SLC Technologies, Inc., Tualatin, Oreg.

[21] Appl. No.: 824,683

[22] Filed: Apr. 8, 1997

[51] Int. Cl.[6] ..... H01H 9/00

[52] U.S. Cl. ..... 335/205; 340/547

[58] Field of Search ..... 335/205–7, 302; 340/587, 686

[56] References Cited

U.S. PATENT DOCUMENTS

| | | | |
|---|---|---|---|
| 3,896,404 | 7/1975 | Peterson . | |
| 4,242,657 | 12/1980 | Chaillot . | |
| 4,571,528 | 2/1986 | McGee et al. . | |
| 4,700,163 | 10/1987 | Wolfe, Jr. . | |
| 4,745,383 | 5/1988 | Zovath et al. | 335/205 |
| 4,827,091 | 5/1989 | Behr . | |
| 4,903,010 | 2/1990 | Greene . | |
| 4,933,515 | 6/1990 | Behr et al. . | |
| 4,999,599 | 3/1991 | Spier | 335/205 |
| 5,416,456 | 5/1995 | Light | 335/206 |
| 5,438,869 | 8/1995 | Mueller et al. . | |
| 5,635,887 | 6/1997 | Fischette et al. | 335/205 |

OTHER PUBLICATIONS

Magnet Sales & Manufacturing Inc., "High Performance Permanent Magnets," pp. vi and vii, 1995.

Cookson Magnet Sales, Inc., "High Performance Permanent Magnets," pp. 1–1–5–16, 1993.

*Primary Examiner*—Lincoln Donovan

*Attorney, Agent, or Firm*—Stoel Rives LLP

[57] ABSTRACT

A resilient and compressible door channel magnet module facilitates the installation of a door channel magnet. The module comprises a magnet set supported inside a magnet holder that is connected to a flexible and deformable outer ring by a set of elongate web members. To install, the module is compressed, positioned in the door channel, and released. The pressure of the module against the walls of the door channel retains the module in position. A preferred module includes a rare earth magnet backed with a ceramic magnet for producing the requisite magnetic field strength at less cost than a sole rare earth magnet of equal magnetic field strength.

16 Claims, 2 Drawing Sheets

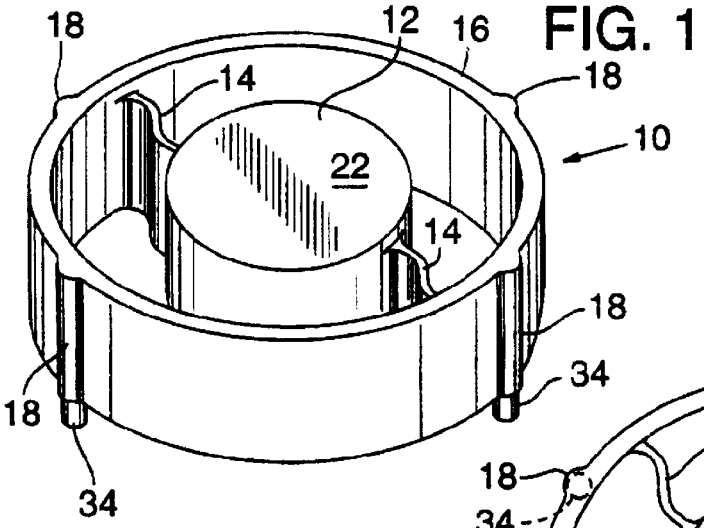
FIG. 1
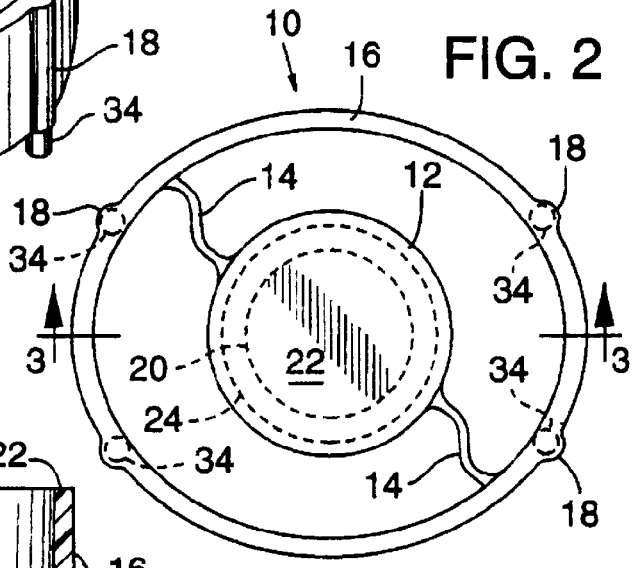
FIG. 2
FIG. 3
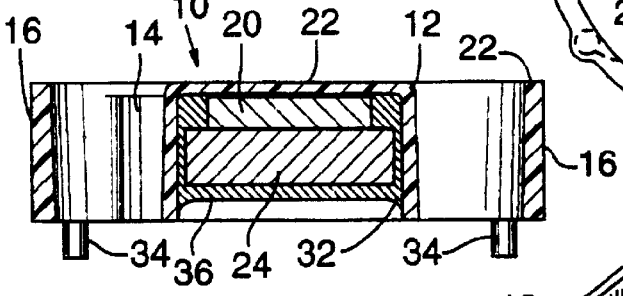
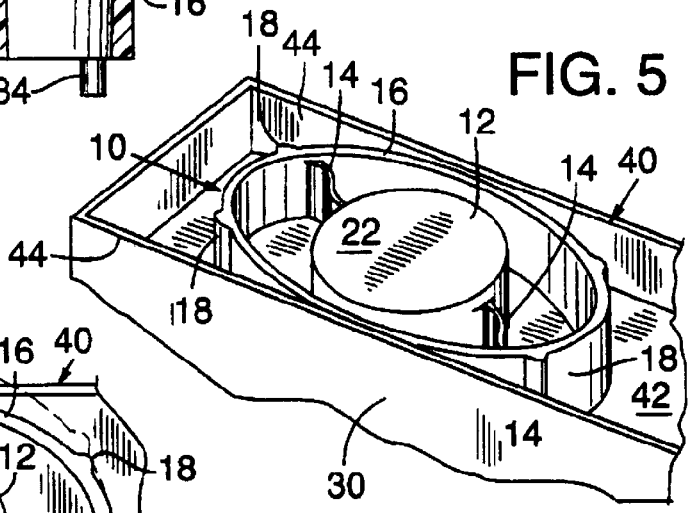
FIG. 5
FIG. 4
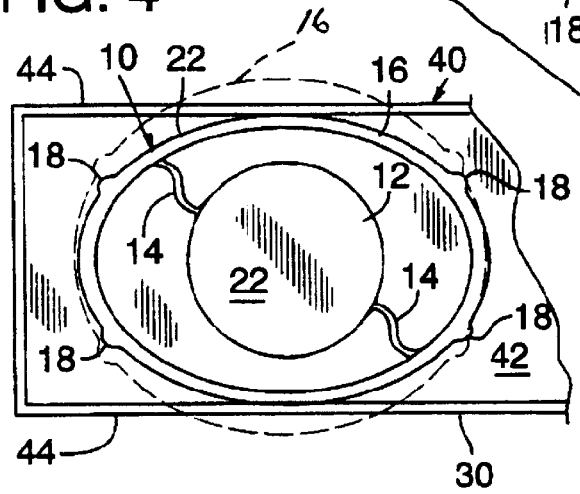

RESILIENT AND COMPRESSIBLE MAGNET MODULE FOR DOOR CHANNEL INSTALLATION

TECHNICAL FIELD

The present invention is related to a door channel magnet module for use in conjunction with a reed switch to form a sensor for determining whether a door is closed.

BACKGROUND OF THE INVENTION

Large buildings constructed today typically are equipped with metal doors in many locations. These doors are frequently made of two sturdy steel or aluminum sheets, spaced apart and rigidly connected together by steel U-beams extending in the interior plane of the door. At the top side margin of this type of door, there is typically a "door track" or "door channel" defined by an upwardly pointing horizontal U-beam.

For security purposes, this type of door is also typically equipped with an electronic sensor for determining whether the door is open or closed. The sensor comprises a magnet that is positioned within the door channel and a magnetically actuated reed switch that is positioned in a corresponding location in the doorjamb, so that when the door is shut the magnet is placed in proximity to the reed switch, thereby actuating it. The magnet is not placed directly on the steel sheet because such placement would distort and attenuate the magnetic field, thereby preventing it from actuating the reed switch.

Heretofore, each door channel magnet was supported in a rigid magnet housing that was fastened to the door channel by, for example, a screw extending through one of the steel sheets. Unfortunately, this type of arrangement necessitated the breaching of the steel sheet, thereby violating the integrity of the door and reducing its ability to resist fire. In addition, the task of screwing the magnet housing onto the steel sheet is time-consuming, adding to the labor required for the installation of a security system.

Another problem encountered in the design of this type of door magnet is the difficulty of using aluminum-nickel-cobalt (alnico) magnets—the typical type of magnet that was heretofore used for this type of device—when there is little vertical space available in the door channel. When the diameter-to-length (vertical dimension) ratio exceeds a particular level, alnico magnets tend to self-demagnetize. To accommodate longer lengths, drilling of a hole is often necessary, thus violating the integrity of the door. This also adds to the labor required for installation. There is, therefore, an advantage to the use of rare earth magnets, which do not suffer from this geometry problem. Unfortunately, a rare earth magnet suitable to generate a sufficient magnetic field is more expensive than a comparable alnico magnet.

SUMMARY OF THE INVENTION

It is, therefore, an object of the present invention to provide an easy-to-install door channel magnet module.

It is an advantage of the present invention that the door channel magnet module can be installed without violating the integrity of the door.

It is another advantage of the present invention that a sufficient magnetic field is generated using a reduced amount of rare earth magnetic material.

The present invention comprises a resilient and compressible door channel magnet module having resilient elongate web members extending outwardly therefrom. A resilient elliptical ring member is attached to the outer ends of the flexible elongate web members.

In another aspect of the present invention, the magnet of the module comprises a rare earth magnet configured in juxtaposition with a permeable substance such as steel or a ceramic magnet. This configuration provides a sufficient magnetic field to actuate the reed switch at a cost that is less than the cost of a comparable magnet made entirely of rare earth magnetic material sufficient to produce a magnetic field capable of actuating the reed switch.

A further aspect of the present invention comprises a method of installing a magnet module into a door track, including the steps of providing a resilient and compressible magnet module, compressing the resilient module and placing it in the door channel, and releasing the module so that its sides press against and thereby retain the module in the door channel.

Additional objects and advantages of this invention will be apparent from the following detailed description of a preferred embodiment thereof, which proceeds with reference to the accompanying drawings.

BRIEF DESCRIPTION OF THE DRAWINGS

FIG. 1 is an isometric drawing of the magnet module of the present invention;

FIG. 2 is a top view of the magnet module of FIG. 1;

FIG. 3 is a sectional view taken along lines 3—3 of FIG. 2;

FIG. 4 is a fragmentary top view of the magnet module of FIG. 1, shown as installed in a door channel;

FIG. 5 is a fragmentary isometric drawing of the magnet module of FIG. 1, shown as installed in a door channel.

DETAILED DESCRIPTION OF A PREFERRED EMBODIMENT

Figure 6:
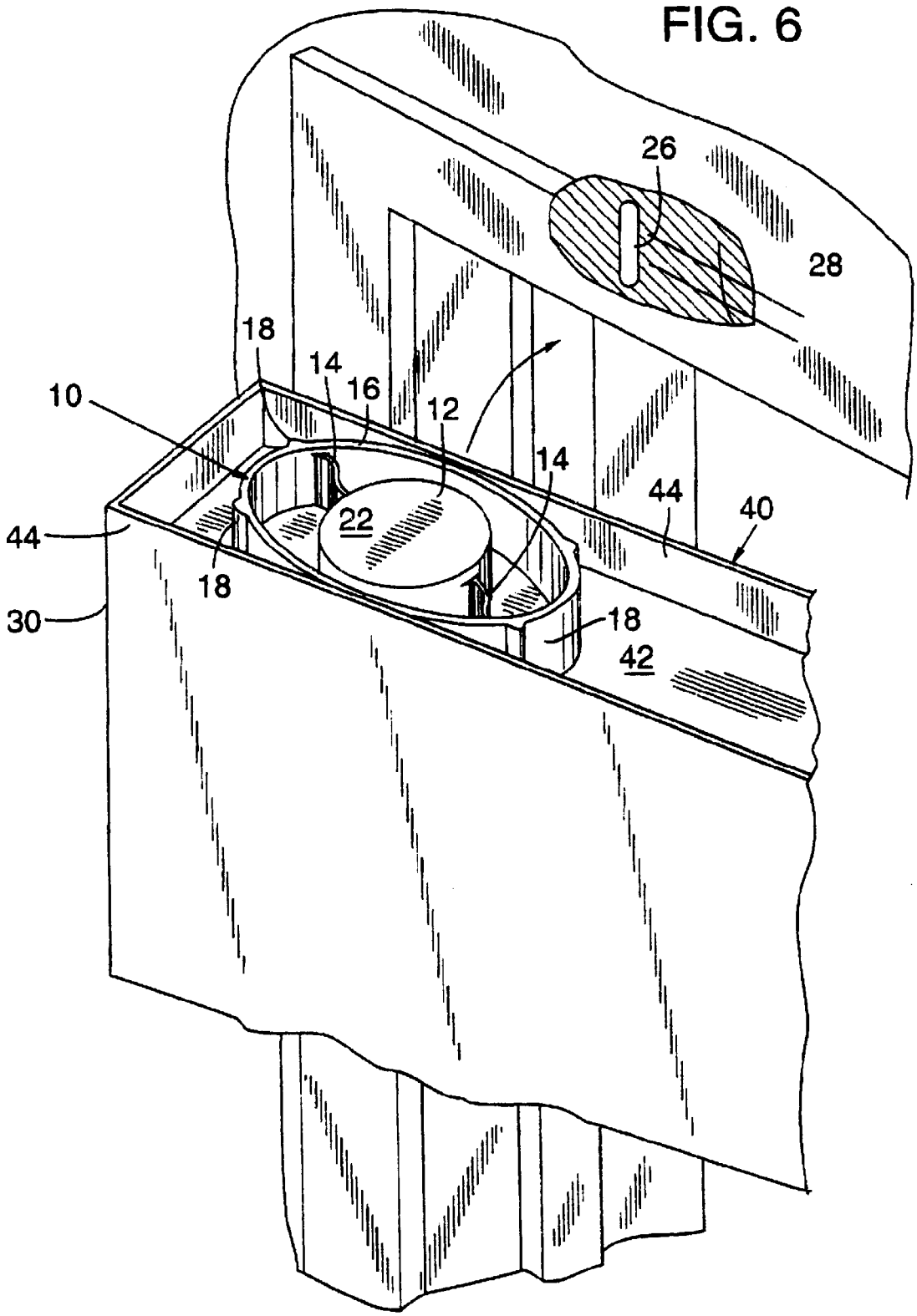
FIG. 6 is a fragmentary isometric drawing of a door equipped with the magnet module of FIG. 1 and an associated doorjamb.

With reference to FIGS. 1–3, a resilient magnet module 10 comprises a magnet holder 12 in the form of an inverted center cup, a pair of S-shaped resilient elongate web members 14, positioned 180° apart between an outer surface of magnet holder 12 and an inner surface of a resilient outer ring member 16 having a set of outer ribs 18. In its relaxed or uncompressed state, ring member 16 is in the form of a closed, preferably elliptical, curve. Magnet holder 12 contains a rare earth (typically neodymium) magnet 20 placed near a top surface 22 of magnet holder 12. Adjacent to the bottom of rare earth magnet 20 is a ceramic backing magnet 24. Magnets 20 and 24 together create a magnetic field with a strength of preferably about 20 gauss when measured 2.54 cm (1.0 in) directly above magnet holder 10.

The placement of ceramic backing magnet 24 augments the magnetic field created by rare earth magnet 20 in the region above top surface 22, which will spatially coincide with the position of a reed switch 26 (FIG. 6) installed in a doorjamb 28 (to which a door 30 is hinged) when door 30 is closed. Rare earth magnet 20 and ceramic backing magnet 24 are held in place by a potting material 32. A set of legs 34 spaced apart around the periphery and extending below a bottom surface 36 formed by the potting material 32 sealing the opening of magnet holder 12 helps to isolate the ceramic backing magnet 24 by distancing it from a metallic bottom surface 42 of a door channel 40 (FIGS. 4, 5, and 6) into which module 10 is installed, which would otherwise distort and attenuate the field produced by magnets 20 and 24. Legs 34 also elevate rare earth magnet 20 so that it is closer to reed switch 26 (FIG. 6) when door 30 is closed.

FIGS. 4, 5, and 6 illustrate the placement of module 10 into door channel 40. The sides of ring member 16 are squeezed inwardly, and module 10 is positioned into channel 40 where the sides of ring member 16 press against the sides of and thereby retain module 10 in door channel 40. (FIG. 4 shows in phantom lines ring member 16 in uncompressed form.) In a preferred embodiment, ring member 16 (and therefore module 10) has a major uncompressed axis of 4.605 cm (1⅘ in) for forming a compressed fit for a 4.445 cm (1¾ in) door and a minor uncompressed axis 6 of 4.1275 cm (1⅝ in) for forming a compressed fit for a 3.495 cm (1⅜ in) door. Magnet holder 12 has a diameter of 2.26 cm (⅞ in) . Rare earth magnet 20 is a toroid with an outer diameter of 1.5 cm (⅗ in), a height of 0.3 cm (1/9 in) and an inner diameter of 0.3 cm (1/9 in). Ceramic backing magnet 24 is a disk with a diameter of 1.8542 cm (¾ in) and a height of 0.508 cm (⅕ in). For either a 3.495 cm (1⅜ in) door or a 4.445 cm (1¾ in) door, the use of rare earth magnet 20 and ceramic backing magnet 24 permit magnet module 10 to be of a small enough size to fit into door channel 40.

An advantage to having two equally resilient elongate web members 14 as opposed to some other number, for example, three or four, is that two members 14 allow freer play and rotation of magnet holder 12, thereby permitting easier compression of ring member 16 and centering of holder 12. Magnet holder 12, resilient elongate web members 14, and ring member 16 are molded out of acrylonitrile butadiene styrene plastic.

It will be obvious to those having skill in the art that many changes may be made to the details of the above-described embodiment of this invention without departing from the underlying principles thereof. The scope of the present invention should, therefore, be determined only by the following claims.

We claim:

1. A resilient and compressible magnet module configured to conformably fit within a support structure channel having an interior region with an interior surface, comprising:

a magnet;

a magnet holder disposed about and supporting the magnet;

a plurality of resilient elongate web members, each having a proximal end attached to the magnet holder and extending outwardly therefrom and having a distal end opposed to the proximal end; and a flexible and deformable outer ring member attached to the distal ends of the resilient elongate web members, the outer ring member having an outer surface and being dimensioned to change its shape in response to an externally applied compressive force against the outer surface of the outer ring member so that the magnet module can conformably fit in any one of multiple possible orientations of the outer surface of the outer ring member within the interior region of the support structure channel and after removal of the externally applied compressive force the magnet module remains retained in place under compression by pressure contact of the outer surface of the outer ring member against the interior surface of the support structure channel.

2. The magnet module of claim 1, in which the plurality of resilient elongate web members includes exactly two resilient elongate web members.

3. The magnet module of claim 1, in which the resilient elongate web members are curved.

4. The magnet module of claim 3, in which the curved resilient elongate web members are S-shaped.

5. The magnet module of claim 1, in which the resilient elongate web members interconnect the magnet holder and the flexible and deformable outer ring member so that the magnet remains centered within the flexible and deformable outer ring member when it is compressed.

6. A flexible magnet module configured to conformably fit with a support structure channel, the module having a top for facing outwardly from the support structure and a bottom, opposed to the top and comprising:

a rare earth magnet having a surface;

magnetic material placed adjacent to the surface of the magnet;

a magnet holder disposed about and supporting the magnet and the magnetic material;

a plurality of elongate web members, each having a proximal end attached to the magnet holder and extending outwardly therefrom and having a distal end opposed to the proximal end; and a flexible and deformable outer ring member attached to the distal ends of the resilient elongate web members, the outer ring member having an outer surface and being dimensioned to change its shape in response to an externally applied compressive force against the outer surface of the outer ring member so that the magnet module can conformably fit in any one of multiple possible orientations of the outer surface of the outer ring member within the interior region of the support structure channel and after removal of the externally applied compressive force remains retained in place under compression by pressure contact of the outer surface of the outer ring member against the interior surface of the support structure channel.

7. The magnet module of claim 6 in which the magnetic material is comprised of a ceramic magnet.

8. The magnet module of claim 6 in which the magnetic material is comprised of a magnetically soft material.

9. The magnet module of claim 6 in which the rare earth magnet is comprised of neodymium.

10. The magnet module of claim 1, in which the flexible and deformable outer ring members completely encircles the magnet holder and has an inner surface, to which the distal ends of the resilient elongate web members are attached.

11. The magnet module of claim 10, in which the flexible and deformable outer ring member assumes an elliptical shape in the absence of the externally applied compressive force.

12. The magnet module of claim 10, in which there is an open space between the magnet holder and the inner surface of the flexible and deformable outer ring member in the absence of the externally applied compressive force.

13. The magnet module of claim 1, in which the interior surface of the interior region has a bottom surface portion, and further comprising multiple legs attached to the outer ring member and extending in a transverse direction from its outer surface so that when the magnet module is placed in the support structure channel the multiple legs position the magnet holder a distance away from the bottom surface portion.

14. The magnet module of claim 1, in which the magnet comprises a rare earth magnet.

15. The magnet module of claim 14, in which the rare earth magnet includes neodymium.

16. The magnet module of claim 8, in which the magnetically soft material includes steel.

* * * * *